United States Patent [19]

Economopoulos et al.

[11] Patent Number: 4,577,478

[45] Date of Patent: Mar. 25, 1986

[54] LOCKING FILLER TUBE COVER APPARATUS FOR UNDERGROUND FUEL TANKS

[76] Inventors: Dennis O. Economopoulos; Othon Economopoulos, both of 3589 Beaconsfield, Detroit, Mich. 48224

[21] Appl. No.: 526,709

[22] Filed: Aug. 26, 1983

[51] Int. Cl.[4] ..... B65D 55/14

[52] U.S. Cl. ..... 70/168; 70/DIG. 63

[58] Field of Search ..... 70/333 R, 333 A, 163, 70/164, 166, 167, 168, 416, 424, 427, 428, DIG. 63; 292/36

[56] References Cited

U.S. PATENT DOCUMENTS

| | | | |
|---|---|---|---|
| 596,956 | 1/1898 | Boyles . | |
| 845,182 | 2/1907 | Letts . | |
| 961,088 | 6/1910 | Reynolds . | |
| 1,046,438 | 12/1912 | Caldwell . | |
| 1,294,949 | 2/1919 | Roberts . | |
| 1,788,118 | 1/1931 | Meyer . | |
| 1,878,362 | 9/1932 | Banasik . | |
| 2,039,124 | 4/1936 | Stryker | 296/76 |
| 2,315,644 | 4/1943 | Nahm | 70/163 X |
| 2,650,388 | 9/1953 | White | 16/147 |
| 2,823,536 | 2/1958 | Watson | 70/1.5 |
| 3,477,261 | 11/1969 | Siana | 70/427 |
| 3,778,079 | 12/1973 | Vornberger et al. | 292/36 X |
| 3,975,934 | 8/1976 | Babai et al. | 70/120 |
| 3,991,595 | 11/1976 | Bahry et al. | 70/120 |
| 4,046,410 | 9/1977 | Connell | 292/36 |
| 4,070,882 | 1/1978 | Ruiz | 70/427 |
| 4,223,943 | 9/1980 | Van Hulle et al. | 292/36 X |
| 4,228,746 | 10/1980 | Caton | 70/168 X |
| 4,237,710 | 12/1980 | Cardozo | 70/108 |
| 4,362,328 | 12/1982 | Tacheny et al. | 292/36 |

*Primary Examiner*—Robert L. Wolfe

*Attorney, Agent, or Firm*—Basile, Weintraub & Hanlon

[57] ABSTRACT

A locking cover apparatus for underground fuel tanks includes a cover having a depending annular flange mountable over the open end of a fuel tank filler tube. A lock is mounted on a boss secured to the bottom surface of the cover and rotates a plate between a locked position and an unlocked position. A plurality of lock bars are pivotally attached to the plate and are extensible and retractable through apertures in the depending flange and apertures in the filler tube for attaching and releasing the cover from engagement with the filler tube. First and second cover members respectively cover the lock and the boss in which the lock is mounted on the cover. Specially configured keys are insertable into cavities formed in the first and second cover members to permit authorized removal of the cover members from the cover.

8 Claims, 6 Drawing Figures

LOCKING FILLER TUBE COVER APPARATUS FOR UNDERGROUND FUEL TANKS

BACKGROUND OF THE INVENTION

1. Field of the Invention

This invention relates, in general, to covers for underground fuel tanks, manholes, delivery chutes, etc., and, more specifically, to locking covers for underground fuel tanks, manholes, delivery chutes, etc., which prevent unauthorized removal of the cover.

2. Description of the Prior Art

Locking covers have been provided for underground fuel tanks, manholes, delivery chutes, etc. Typically the cover is in the form of a circular disc, having a centrally located bolt, key operated lock, etc. A plurality of arms or bars are pivotally mounted to a plate or shaft which is rotated by the bolt or key operated lock into engagement with apertures formed in the surrounding structure, such as on the side walls of the chute, fuel tank filler tube, etc.

While such locking covers have found widespread use, they are susceptible to frequent damage since the bolt or lock is exposed to the environment. More importantly, the exposed bolt or lock can easily be tampered with and/or broken open by unauthorized individuals.

Thus, it would be desirable to provide a locking cover for use with underground fuel tanks and the like which overcomes the problems of previously devised locking covers. It would also be desirable to provide a locking cover for underground fuel tanks which can be securely mounted on the fuel tank to prevent unauthorized removal of the cover and access to the contents of the fuel tank. It would also be desirable to provide a locking cover for underground fuel tanks in which the lock is covered from the external environment. Finally, it would be desirable to provide a locking cover for use with underground fuel tanks which includes additional security means to prevent unauthorized tampering with the lock.

SUMMARY OF THE INVENTION

The present invention comprises a locking filler tube cover apparatus for underground fuel tanks. The locking cover apparatus includes a cover having a depending annular flange which is disposed over the top of the fuel tank filler tube. A lock is mounted on a boss secured to the bottom surface of the cover and rotates a plate attached thereto between locked and unlocked positions.

A plurality of locked bars are pivotally attached to the plate and are extensible and retractable through the apertures in the depending flange of the cover and apertures formed in the fuel tank filler tube to lock the cover on the filler tube and prevent its unauthorized removal.

First and second cover members respectively cover the lock and the boss in which the lock is mounted. Specially formed keys are inserted into correspondingly shaped cavities formed in the first and second cover members to permit the first and second cover members to be mounted on the cover and to enable their removal for access to the lock.

The locking cover apparatus of the present invention overcomes many of the problems associated with previously devised locking covers for underground fuel tanks. The locking cover apparatus of the present invention securely locks the cover on the filler tube of an underground fuel tank and prevents its unauthorized removal. More importantly, specially configured keys must be employed for removing the first and second cover members mounted over the lock on the cover so as to enable access to the lock itself. This provides additional security for the locking cover apparatus of the present invention and, further, covers the lock from the external environment thereby preventing inadvertant damage to the lock.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
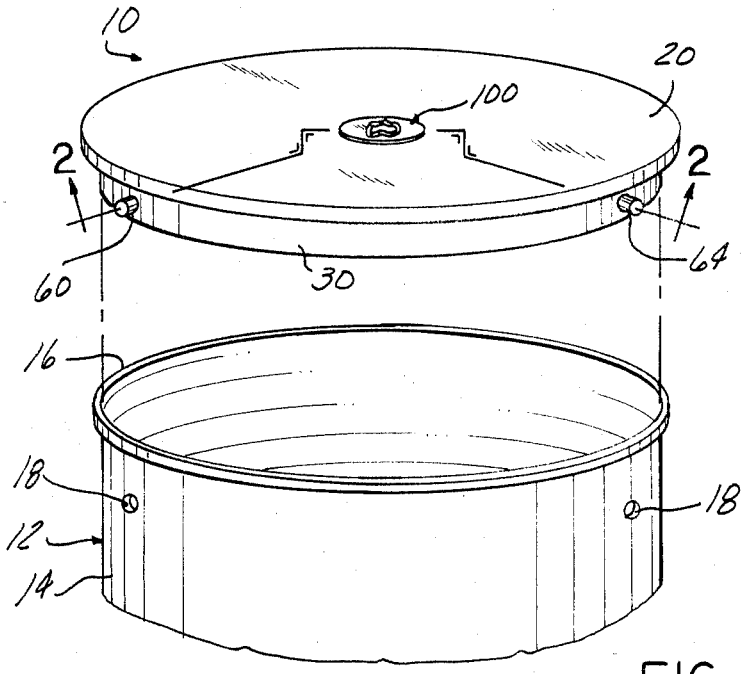
FIG. 1 is an exploded, perspective view of a locking cover apparatus of the present invention.

Throughout the following description and drawing, an identical reference number is used to refer to the same component shown in multiple figures of the drawing.

Referring now to the drawing, and to FIG. 1 in particular, there is illustrated a locking cover apparatus 10 of the present invention which lockingly covers the filler tube 12 from unauthorized access.

As is conventional, the filler tube 12, which is typically employed on underground fuel tanks, includes a vertically extending tube 14 which terminates in an upper lip 16. A plurality of apertures 18 are circumferentially spaced about the upper end of the tube 12.

Figure 2:
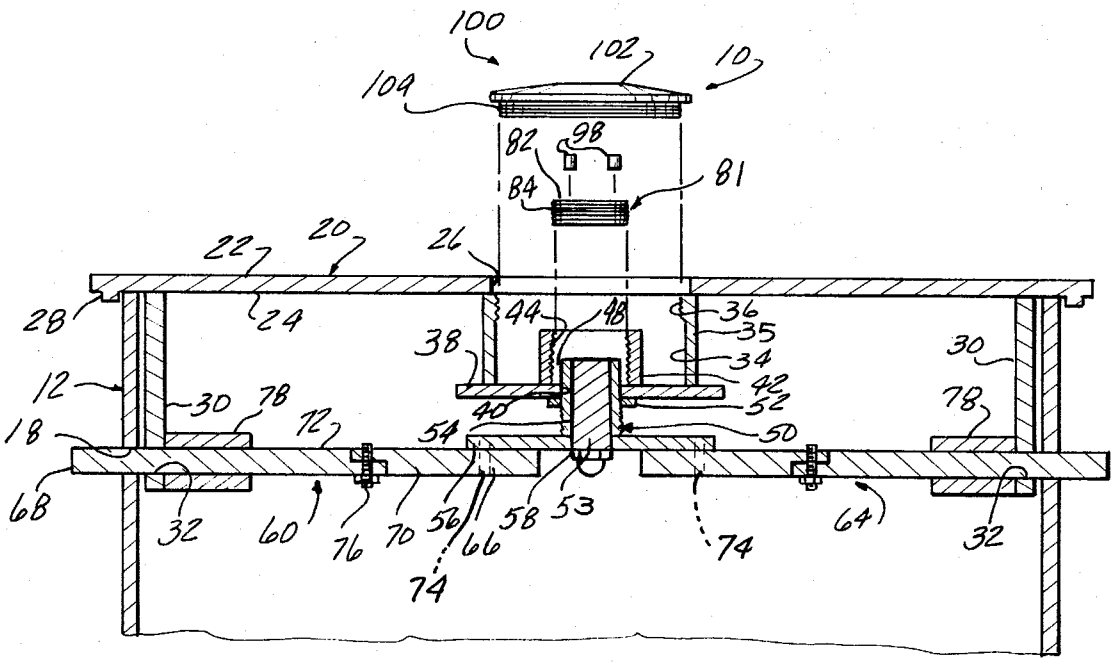
FIG. 2 is a cross-sectional view, generally taken along line 2—2 in FIG. 1.

As shown in FIG. 1, and in greater detail in FIG. 2, the locking cover apparatus 10 of the present invention includes a cover 20 having a generally circular configuration. Although the cover 20 is depicted as having a circular configuration, it will be understood that the cover 20 may have any other shape, such as square, oblong, etc. depending on its application and the shape of the fuel tank filler tube on which it is emplaced. The cover 20 has top and bottom surfaces 22 and 24, respectively, and a centrally located aperture 26.

An outer, annular, depending lip 28 is formed on the bottom surface 24 of the cover 20 and is adapted to be disposed in registry with the upper end of the fuel tank filler tube to securely position the cover 20 on the open end of the filler tube 12. The cover 20 also includes an inner, annular, depending flange 30 which extends a substantial distance below the bottom surface 24 of the cover 20. A plurality of apertures 32 are circumferentially spaced about the flange 30 and are alignable with the apertures 18 in the fuel tank filler tube 12.

A first boss 35 is mounted to the bottom surface 24 of the cover 20. The first boss 35 has a circular configuration with a through bore 34 which is co-axially aligned with the aperture 26 in the cover 20. A plurality of internal threads 36 are formed on the top end of the first boss 35. A plate 38 is secured to the lower end of the first boss 35. The plate 38 also includes a centrally located aperture 40 which is co-axially aligned with the aperture 26 in the cover 20.

A second boss 42 is also mounted on the plate 38. The second boss 42 includes a through bore 44 which is co-axially aligned with the aperture 26 in the cover 20. A plurality of threads 48 are formed internally in the second boss 42.

The locking cover apparatus 10 of the present invention also includes a lock means 50. Although any conventional lock may be employed, the lock means 50 of the present invention has a circular cross-section and includes a centrally located, rotatable shaft 53 which is rotatable upon the insertion of a key not shown, therein. The lock means 50 is mounted on the plate 38 by means of a nut 52 which engages external threads 54 formed on the lock means 50.

A second plate 56 is mounted on the lower end of the lock means 50 by means of a nut 58 which engages the external threads 54 formed on the lock means 50. The plate 56 is thus rotatable upon rotation of the lock means 50 between the first and second or locked and unlocked positions as described in greater detail hereafter.

As shown in FIGS. 1–4, the locking cover apparatus 10 of the present invention includes at least one and, preferably, a plurality of lock bars. In a preferred embodiment, three equally spaced lock bars 60, 62 and 64 are provided.

Preferably, each of the lock bars 60, 62 and 64 is in the form of an elongated bar having first and second ends, such as ends 66 and 68 for the lock bar 60. Although each of the lock bars 60, 62 and 64 may be formed of a single elongated bar, in a preferred embodiment, each of the lock bars 60, 62 and 64 is formed with first and second portions, such as first and second portions 70 and 72 for the lock bar 60. One each of the first portion 70 of the lock bar 60 is pivotally connected by means of a pivot pin 74 to the plate 56. The opposite end of the first portion 70 is pivotally connected by means of an articulated joint 76 to one end of the second portion of the lock bar 60. In this manner, the first portion may pivot with respect to the second portion 72.

Figure 3:
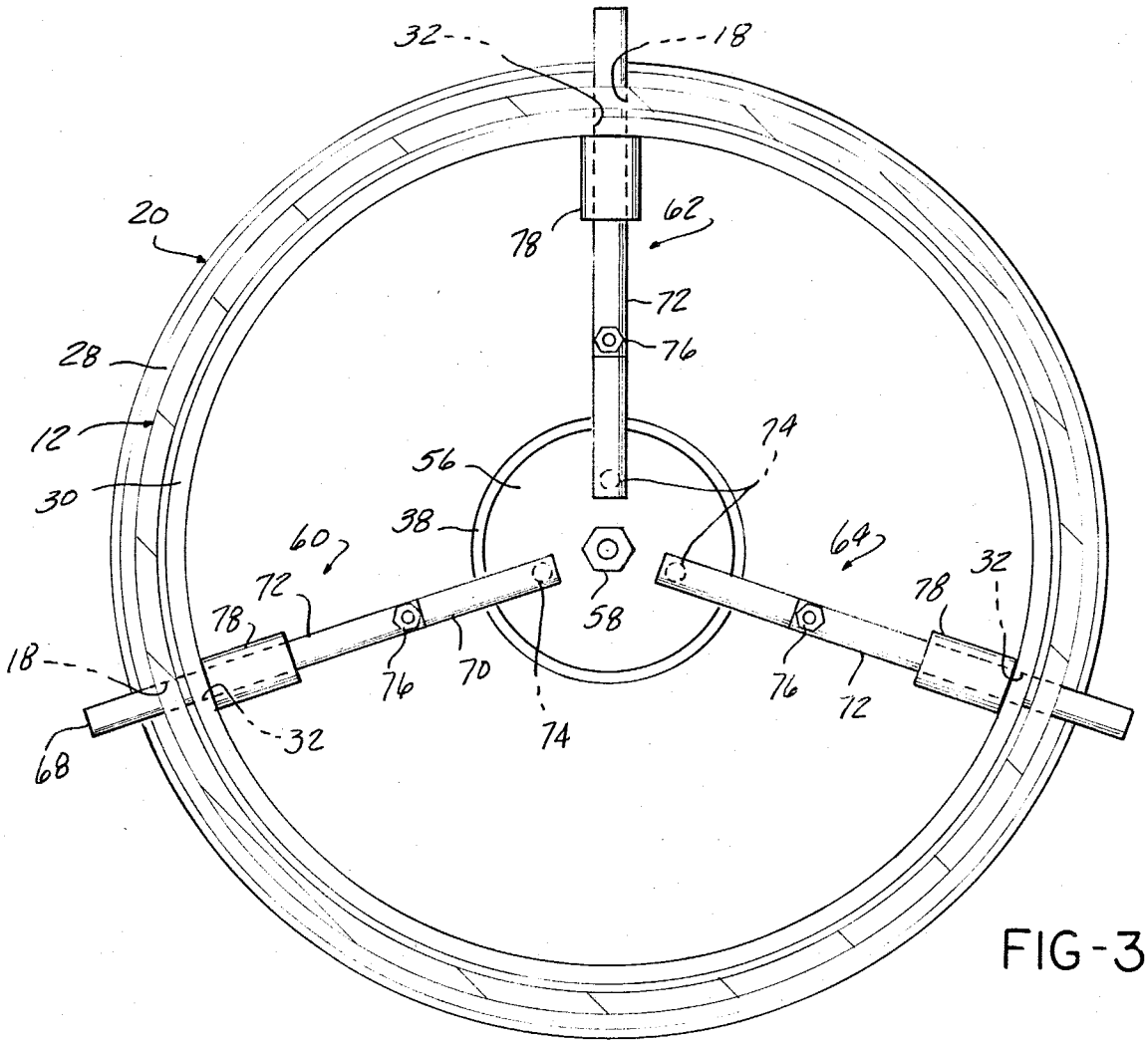
FIG. 3 is a bottom view of the cover depicted in FIG. 1 showing the position of the components of the lock of the present invention in the locked position.
Figure 4:
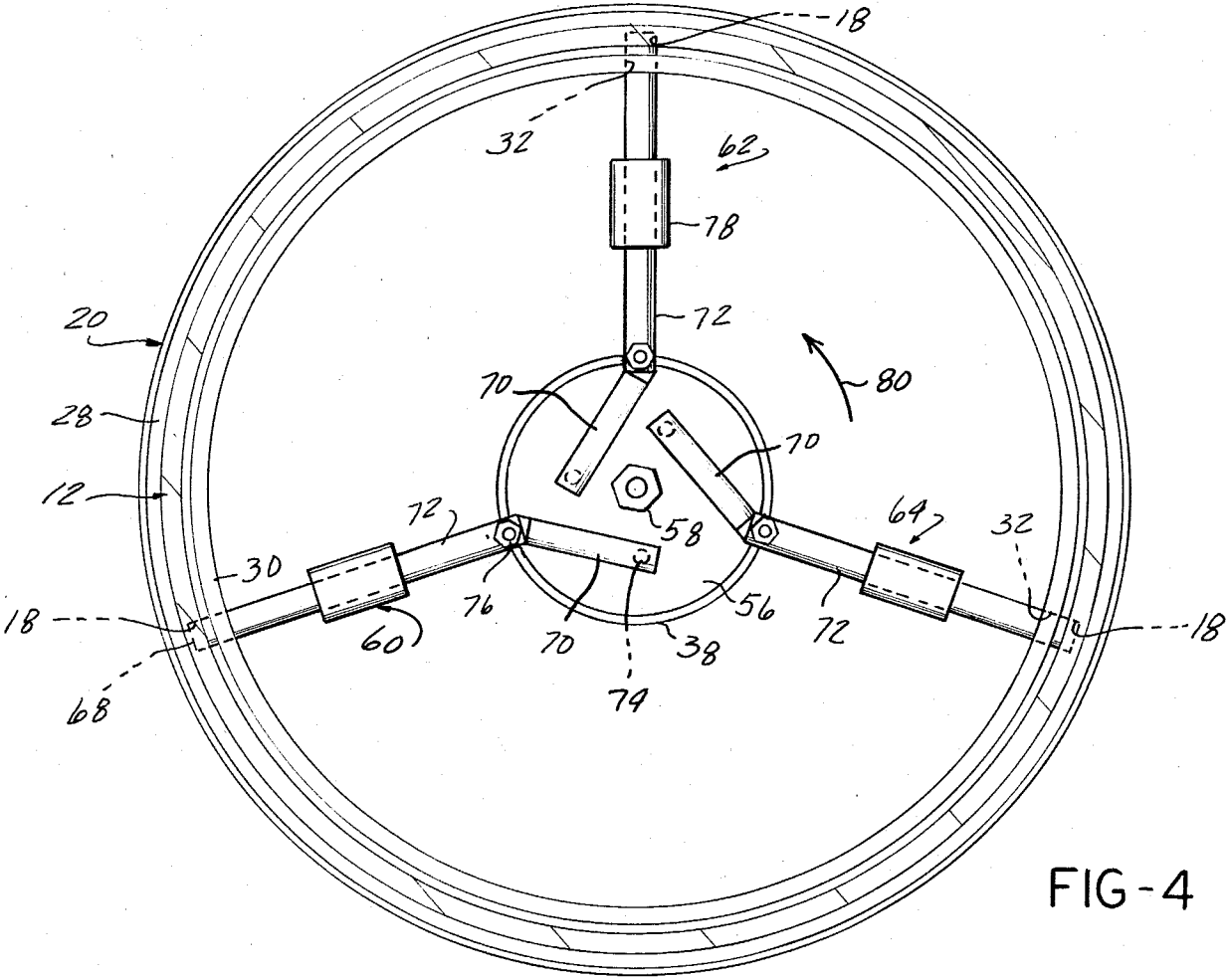
FIG. 4 is a bottom view, similar to FIG. 3, but showing the position of the components of the lock in the unlocked position.

As shown in FIGS. 3 and 4, the second portions 72 of each lock bar extend through the apertures 32 formed in the depending flange 30 of the cover 20. Furthermore, the second portions 72 of each lock bar 60, 62 and 64 are extensible and retractable into and out of the apertures 18 formed in the fuel tank filler tube 12. In the extended position, the second portions 72 of each lock bar 60, 62 and 64 extend through the apertures 18 in the filler tube 12 to securely lock the cover 20 on the filler tube 12. In the unlocked position, as shown in FIG. 4, the second portions 72 of each lock bar 60, 62 and 64 are retracted from the apertures 18 in the filler tube 12 to permit removal of the cover 20 from the filler tube 12.

Guide means 78 are mounted on the depending flange 30 of the cover 20 for guiding movement of the second portions 72 of each lock bar 60, 62 and 64. Preferably, each guide means 78 comprises a sleeve having a hollow bore extending therethrough which slidingly receives the second portions 72 of each lock bar 60, 62 and 64.

In operation, when the lock means 50 and plate 56 attached thereto are rotated to the locked position shown in FIG. 3, the first and second portions 70 and 72 of each lock bar 60, 62 and 64 are aligned such that the second portions 72 extend outward from the plate 56 and engage the apertures 18 in the filler tube 12 to securely lock the cover 20 on the filler tube 12.

If it is desired to remove the cover 20 from the filler tube 12 so as to allow access to the underground fuel tank, the lock 50 is rotated to the unlocked position which causes concurrent rotation of the plate 56 in the direction of arrow 80, as shown in FIG. 4. The rotation of the plate 56 causes the first and second portions 70 and 72 of each lock bar 60, 62 and 64 to pivot with respect to each other about each articulated joint 76. This causes the first and second portions 70 and 72, respectively, of each lock bar 60, 62 and 64 to assume the positions shown in FIG. 4 in which the outer ends 68 of each lock bar 60, 62 and 64 are retracted from the apertures 18 in the filler tube 12 to enable removal of the cover 20 from the filler tube 12.

Figure 6:
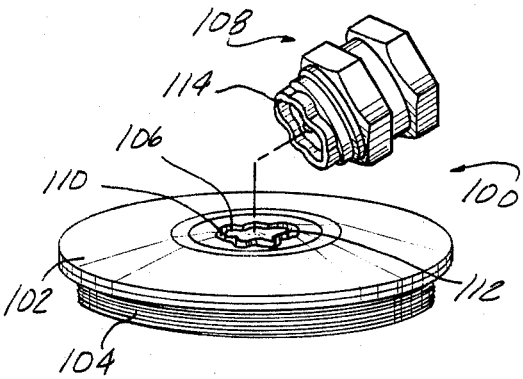
FIG. 6 is an exploded, perspective view of the second cover member and key locking cover employed in the locking cover apparatus of the present invention.
Figure 5:
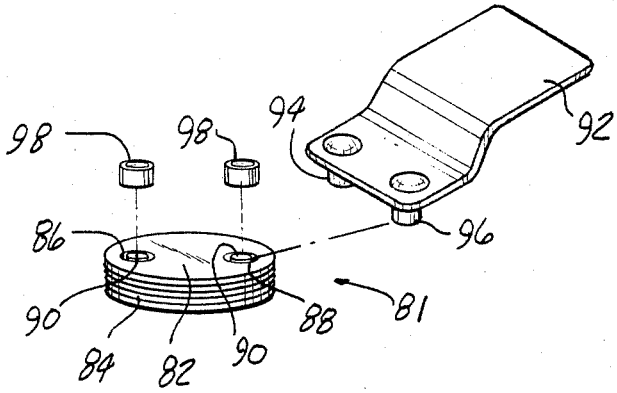
FIG. 5 is an exploded, perspective view of the first cover member and key locking cover employed in the locking cover apparatus of the present invention.

Referring now to FIGS. 2, 5 and 6, there is illustrated first and second cover means 81 and 100, respectively, which are adapted to cover the lock means 50 mounted on the cover 20. The first cover means 81 comprises a disc 82 having a circular cross-section. A plurality of external threads 84 are formed about the periphery of the disc 82 for threading engagement with the internal threads 48 in the second boss 42. In this manner, the disc 82 may be threadingly engaged with the second boss 42 to prevent access to the lock means 50 housed within the interior of the second boss 42.

At least one and, preferably, a pair of cavities 86 and 88 are formed within and extend partially through the disc 82. In a preferred embodiment, the cavities 86 and 88 have a cylindrical configuration which includes an interiorly located, upwardly extending pin 90 defining an annular space between the pin 90 and the side walls of the cavities 86 and 88. A first key means 92 having a pair of outwardly extending projections 94 and 96 is provided for insertion into the cavities 86 and 88. The first key 92 enables the disc 82 to be easily threaded into or out of the second boss 42.

A pair of sleeves 98 are provided for insertion into the cavities 86 and 88. The sleeves 98 have a configuration complementary to the shape of the annular ring portion of the cavities 86 and 88 and, in general, comprise a thin walled member having a hollow bore extending therethrough. Preferably, the sleeves 98 are formed of a magnetizable material, while the disc 82 is formed of a non-magnetic material.

The sleeves 98, when inserted into the cavities 86 and 88 in the disc 82, prevent insertion of the first key 92 into the disc 82 so as to prevent unauthorized removal of the disc 82 from the boss 42 and thereby access to the lock means 50 housed therein. A magnet may be passed over the top surface of the disc 82 to attract and remove the sleeves 98 from the cavities 86 and 88 and enable the key 92 to be inserted therein for authorized removal of the disc 82 from the boss 42. Alternately, the key 92 itself may be formed of a magnetizable material so as to perform the dual function of removing the sleeves 98 from the cavities 86 and 88, as well as insertion into the cavities 86 and 88 in the boss 42.

The locking cover apparatus 10 of the present invention also includes a second cover means 100 shown in FIGS. 2 and 6. The second cover means 100 is in the form of a circular disc 102 having a plurality of external threads 104 formed on a lower portion thereof. The threads 104 threadingly engage the threads 36 formed in the first boss 35 mounted on the cover 20. The second cover means functions to overlie the first cover means 81 and provides a smooth surface on the cover 20 to prevent dirt and other debris from entering the lock mechanism of the locking cover apparatus 10 of the present invention.

Insertion or removal of the second cover means 100 within the first boss 32 in the cover 20 is enabled by means of a cavity 106 in the disc 102 and a complementarily formed second key means 108. The cavity 106 has a contoured configuration defining a recessed portion 110 and an interiorly located, upwardly extending pin 112.

The second key means 108 has a complementarily formed, hollow plug portion 114 which is adapted to be inserted within the recess 110 in the cavity 106 to enable rotation of the disc 102 and allow its threading engagement or disengagement with respect to the first boss 32 in the cover 20.

In summary, the locking cover apparatus of the present invention provides several advantages over previously devised covers mountable on underground fuel tanks, manholes, delivery chutes, etc. The locking cover apparatus of the present invention enables the cover to be securely locked onto the underlying structure, such as an underground fuel tank, and prevents unauthorized access to the underlying structure unless the operator has the proper keys for unlocking the cover. As described above, the locking cover apparatus of the present invention requires three different keys for unlocking the lock itself as well as the first and second cover members which overlie the lock and cover the lock from view and unauthorized access. The cover members also seal the lock itself from the external environment so as to prevent damage to the lock.

What is claimed is:

1. A locking apparatus for underground fuel tanks having a vertically extending filler tube with a plurality of apertures in the side walls thereof, the locking apparatus comprising:

a cover having top and bottom surfaces and a centrally located aperture;

an annular flange depending from the bottom surface of the cover, having a plurality of apertures formed in the flange and alignable with the apertures in the fuel tank filler tube;

lock means mounted on the cover and selectively movable between a first locked position and a second unlocked position;

a plate mounted on and rotated by the lock means between the first and second positions;

a plurality of lock bars, each slidingly received in one aperture on the flange of the cover, the lock bars having first and second ends, with the first end being pivotally mounted on the plate, and the second end being slidingly engagable with an aperture in the filler tube when the lock means and plate are rotated to the first locked position to lock the cover on the filler tube when the lock means and plate are rotated to the second unlocked position to unlock the cover from the filler tube; and first means for removably covering the lock means to prevent access to the lock means, comprising:

a first boss mounted on the bottom surface of the cover, the first boss having a bore co-axially aligned with the aperture in the cover and including internal threads extending from an upper end thereof;

a disc having external threads on the first boss; engagable with the internal threads on the first boss;

a cavity formed in the disc; and a first key means having an outwardly extending projection complementary to the cavity in the disc and insertable into the cavity to permit removal of the disc from the first boss.

2. The apparatus of claim 1, wherein the cavity comprises:

an annular ring formed in the disc;

a sleeve removably insertable into the ring for closing the ring, the sleeve being formed of a magnetizable material; and magnet means for removing the sleeve from the disc to permit insertion of the first key into the cavity in the disc.

3. The apparatus of claim 2, further including:

a pair of annular rings formed in the disc;

a pair of sleeves for removable insertion into the pair of rings; and the first key means including two outwardly extending projections complementary to the configuration of the annular rings in the disc.

4. The apparatus of claim 1, further including:

a second cover means for preventing access to the lock means.

5. The apparatus of claim 4, wherein the second cover means comprises:

a second boss mounted on the bottom surface of the cover, the second boss having a bore extending therethrough co-axially aligned with the aperture in the cover, the second boss including a plurality of internal threads extending from an upper end thereof; and a second disc having external threads threadingly engageable with the threads in the second boss to close the aperture in the cover.

6. The apparatus of claim 5, further including:

a cavity formed in the second disc; and a second key complementary to the configuration of the cavity for insertion into the cavity to enable the insertion and removal of the second disc from the second boss in the cover.

7. A locking cover apparatus for underground fuel tanks having a vertically extending filler tube with a plurality of apertures formed in the side walls thereof, the locking cover apparatus comprising:

a cover having top and bottom surfaces and a centrally located aperture;

an annular flange depending from the bottom surface of the cover, a plurality of apertures formed in the flange and alignable with the apertures with the fuel tank filler tube;

a first boss carried by the cover and having a through bore extending therethrough and a plurality of internal threads extending from one end;

lock means mounted within the first boss and being selectively movable between a first locked position and a second unlocked position;

a plate mounted on and rotated by the lock means between the first and second positions;

a plurality of lock bars, each slidingly received in one aperture on the flange of the cover and an aperture in the filler tube;

first cover means for covering the lock means, the first cover means including:

a first disc having external threads threadingly engageable with internal threads formed in the first boss;

a cavity formed in the first disc;

first key means having an outwardly extending projection complementary with the cavity in the first disc for insertion into the cavity to permit removal of the first disc from the first boss; and second cover means for covering the aperture in the cover, the second cover means including:

a second boss mounted on the cover and surrounding the first boss;

a second disc having external threads for threading insertion into the second boss to close the aperture in the cover;

a second cavity formed in the second disc; and second key means complementary with the second cavity for selective insertion into the second cavity of the second disc to enable removal of the second disc from the second boss on the cover.

8. The locking cover apparatus of claim 7 wherein each of the locking bars includes:

first and second pivotally connected portions, one end of the first portion being pivotally attached to the plate; and the second portion slidingly engaging an aperture in the flange on the cover and an aligned aperture in the fuel tank filler tube.

* * * * *